US011011338B2

(12) United States Patent
Leggieri et al.

(10) Patent No.: US 11,011,338 B2
(45) Date of Patent: May 18, 2021

(54) ANNULAR CATHODE FOR VACUUM TUBE

(71) Applicant: THALES, Courbevoie (FR)

(72) Inventors: Alberto Leggieri, Velizy-Villacoublay (FR); François Legrand, St Remy les Chevreuse (FR); Rodolphe Marchesin, Gif sur Yvette (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 16/922,715

(22) Filed: Jul. 7, 2020

(65) Prior Publication Data

US 2021/0012994 A1 Jan. 14, 2021

(30) Foreign Application Priority Data

Jul. 8, 2019 (FR) ..... 1907279

(51) Int. Cl.

| | |
|---|---|
| ***H01J 19/12*** | (2006.01) |
| ***H01J 19/48*** | (2006.01) |
| ***H01J 1/88*** | (2006.01) |
| ***H01J 19/42*** | (2006.01) |

(52) U.S. Cl.

CPC ..... *H01J 19/12* (2013.01); *H01J 1/88* (2013.01); *H01J 19/42* (2013.01); *H01J 19/48* (2013.01)

(58) Field of Classification Search

CPC ..... H01J 9/12; H01J 1/18; H01J 19/42–52; H01J 21/36

See application file for complete search history.

(56) References Cited

U.S. PATENT DOCUMENTS

| | | | | |
|---|---|---|---|---|
| 2,928,978 | A * | 3/1960 | Morton | H01J 1/16 313/343 |
| 3,265,919 | A * | 8/1966 | Manfredi | H01J 1/20 313/238 |
| 3,631,290 | A | 12/1971 | Loeffler | |
| 3,824,424 | A * | 7/1974 | McNees | H01J 19/34 313/341 |
| 4,563,609 | A * | 1/1986 | Clerc | H01J 1/15 313/20 |
| 5,629,582 | A * | 5/1997 | Dobbs | H01J 23/065 313/257 |
| 6,369,494 | B1 * | 4/2002 | Pruvost | H01J 1/18 313/270 |
| 6,614,158 | B1 * | 9/2003 | Thwaites | H01J 23/065 313/446 |

FOREIGN PATENT DOCUMENTS

FR 2 532 468 A1 3/1984

* cited by examiner

*Primary Examiner* — Mariceli Santiago
(74) *Attorney, Agent, or Firm* — BakerHostetler

(57) ABSTRACT

An annular cathode for a vacuum tube includes a central cylindrical support whose axis is that of the cathode; an outer peripheral electron emitter with annular section whose axis is that of the cathode, extending over the outer perimeter of the cathode; and a folded skirt, secured at an inner end to the central support, and secured, at its outer end, to a plurality of lugs; each lug being disposed in series with the folded skirt, and secured with the folded skirt and with the inner surface of the electron emitter.

10 Claims, 4 Drawing Sheets

ANNULAR CATHODE FOR VACUUM TUBE

CROSS-REFERENCE TO RELATED APPLICATIONS

This application claims priority to foreign French patent application No. FR 1907279, filed on Jul. 8, 2019, the disclosure of which is incorporated by reference in its entirety.

FIELD OF THE INVENTION

The invention relates to an annular cathode for a vacuum tube or electron tube. The present invention relates to the development of high-performance thermoelectrical/thermoionic electron guns, such as gyrotrons. A gyrotron is a power vacuum tube (oscillator), generating a microwave frequency wave.

BACKGROUND

The main drawback with cathodic electron emitters is the contact with the element which supports it.

The electron emitter must be kept in a specific position, but must at the same time be thermally insulated from the rest of the cathode (including the support). In addition, the electron emitter must have a uniform temperature over the whole surface.

The contact of the emitter with the structure which supports it is therefore very important, because it creates several zones exhibiting temperature discontinuities, that are reflected also by asymmetric thermal deformations. This non-uniformity and these deformations affect the quality of the beam emitted by the electron gun.

The use of a single element whose direction of expansion is opposite to that of the main cathode is already known and is limited to a flexible securing element (inclined or conical securing element) which links the electron emitter to the support of the cathode as described for example in the document U.S. Pat. No. 3,631,290 A.

Such an embodiment compensates for a longitudinal expansion of the electron emitter without compensating for the radial and orbital expansions, which implies a deformation of the electron emitter by an anisotropic thermal expansion. These expansions are not balanced and there occurs a non-uniformity of the thermal expansion. At the same time, the presence of discrete contact points between the electron emitter and the traditional connections produces heat flux discontinuities and affects the thermal uniformity of the emitter.

The main difficulties in designing a cathode concern the alignment of the electron emitter and the thermal insulation between the electron emitter and the other parts of the cathode, in particular with the element which supports the emitter.

The electron emitter must be placed in a certain position, so there is an element dedicated to its support, hereinafter called support.

The existing cathodes exhibit, in terms of alignment of the emitters, the following main drawbacks.

The support is sensitive to the deformations induced by the thermal expansion of the materials. These deformations compromise the alignment of the support, the mechanical position of the support at ambient temperature can change after the thermal heating. Often, the mechanical position of the support at ambient temperature may not correspond to its position when the electron emitter is heated up. Consequently, the spatial position of the electron emitter can change before, during and after the heating.

The existing cathodes exhibit, in terms of thermal uniformity, the following main drawbacks.

The support must be in contact, at least partially, with the emitter. This contact is a mechanical contact, which is therefore a thermal contact. The support elements in contact with the electron emitter allow a heat flux which creates temperature differences in the contact zone. This temperature difference provokes a non-uniformity of the temperature of the electron emitter along the surface of the emitter. This non-uniformity of the temperature provokes a non-uniformity of the energy of the emitted electrons, which is reflected by a low beam quality.

FIG. 1 schematically represents a cross-sectional view and a plan view of a cylindrical cathode known from the state of the art, comprising a flexible securing element 1 (inclined or tapered securing element) which links an electron emitter 2 with concave electron-emissive surface to the support 3 of the cathode.

The electron emitter 2 expands in the axial direction of the cathode, in the positive direction, whereas the flexible securing element 1 has a projection of thermal expansion in the same axial direction, but in the negative, opposite direction. The longitudinal expansions of the two structures are practically balanced. However, the radial and orbital expansions are not balanced and the heat flux can be significant at the interface between the electron emitter 2 and the tapered securing element 1. The presence of discrete contact points between the electron emitter 2 and the tapered securing element 1 provokes heat flux discontinuities and affects the thermal uniformity of the electron emitter 2.

SUMMARY OF THE INVENTION

One aim of the invention is to overcome the abovementioned problems.

There is proposed, according to one aspect of the invention, an annular cathode for a vacuum tube, comprising:

- a cylindrical central support whose axis is that of the cathode;
- an outer peripheral electron emitter with annular section whose axis is that of the cathode, extending over the outer perimeter of the cathode; and
- a folded skirt, secured at an inner end to the central support, and secured, at its outer end, to a plurality of lugs;
- each lug being disposed in series with the folded skirt, and secured with the folded skirt and with the inner surface of the electron emitter.

The present invention improves the alignment and the thermal uniformity of the cathode electron emitter in hot operating conditions.

According to one embodiment, the folded skirt is of a single piece.

The use of a single piece skirt makes it possible to limit the number of welds.

As a variant, the folded skirt comprises a plurality of concentric tubular cylinders with circular sections, two consecutive cylinders being linked alternately at one end and at the other of the tubular cylinders by a ring.

The use of such a folded skirt is more easily feasible than a single-piece skirt.

For example, the cylindrical central support has a circular section.

In one embodiment, the annular cathode comprises a fixing support for the lugs disposed between the electron emitter and the lugs.

The presence of such a support simplifies the mounting of the lugs.

For example, the lugs are U-shaped.

Thus, that makes it possible to produce connections in the desired direction with simplified mounting.

According to one embodiment, the lugs are angularly evenly distributed.

Thus, the thermal uniformity is enhanced because the thermal discontinuities are distributed symmetrically in the orbital direction, enhancing the thermal uniformity.

According to one embodiment, the volume-to-surface area ratio of a lug and/or of a cylinder of the folded skirt is less than 0.06 mm.

In one embodiment, a lug has a volume-to-surface area ratio of 0.05 mm.

According to one embodiment, a cylinder of the folded skirt has a volume-to-surface area ratio of 0.025 mm.

Thus, a good trade-off is obtained between a good thermal resistance (fineness) and a good heat exchange by radiation (good surface area), and allows a good isotropic expansion.

BRIEF DESCRIPTION OF THE DRAWINGS

The invention will be better understood on studying a few embodiments described as nonlimiting examples and illustrated by the attached drawings in which.

Throughout the figures, the elements that have the same references are similar.

DETAILED DESCRIPTION

Figure 1:
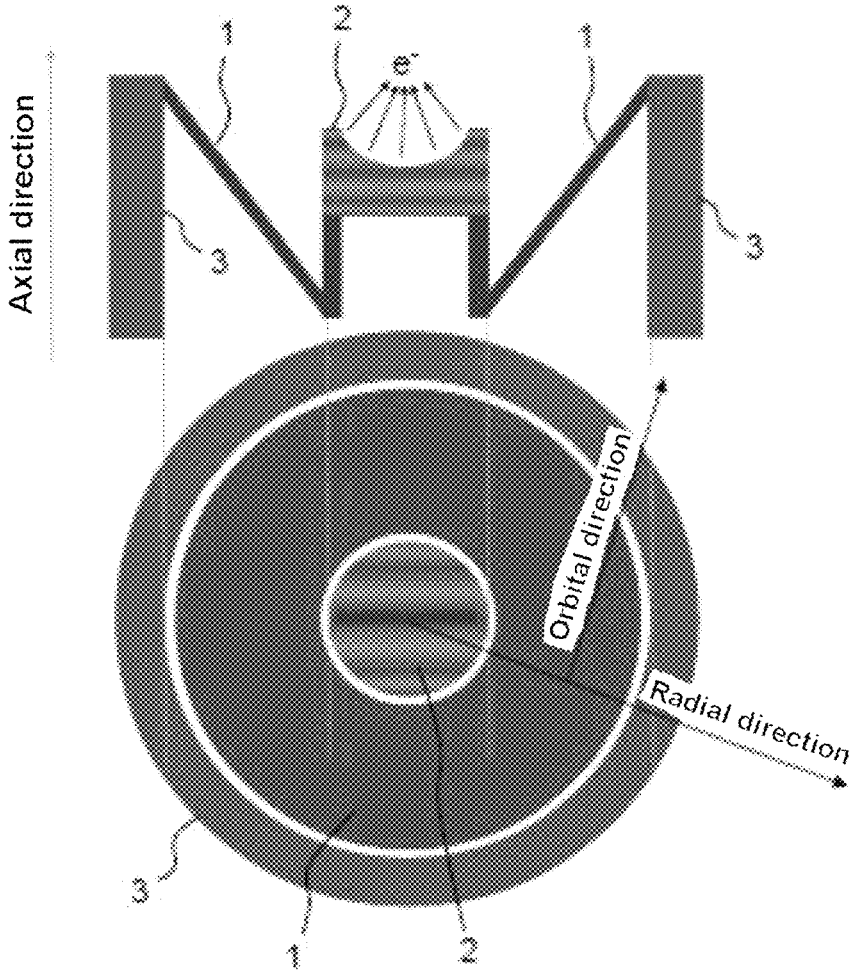
FIG. 1 schematically illustrates a cylindrical cathode in plan view and in cross-sectional view, according to the state of the art.
Figure 2:
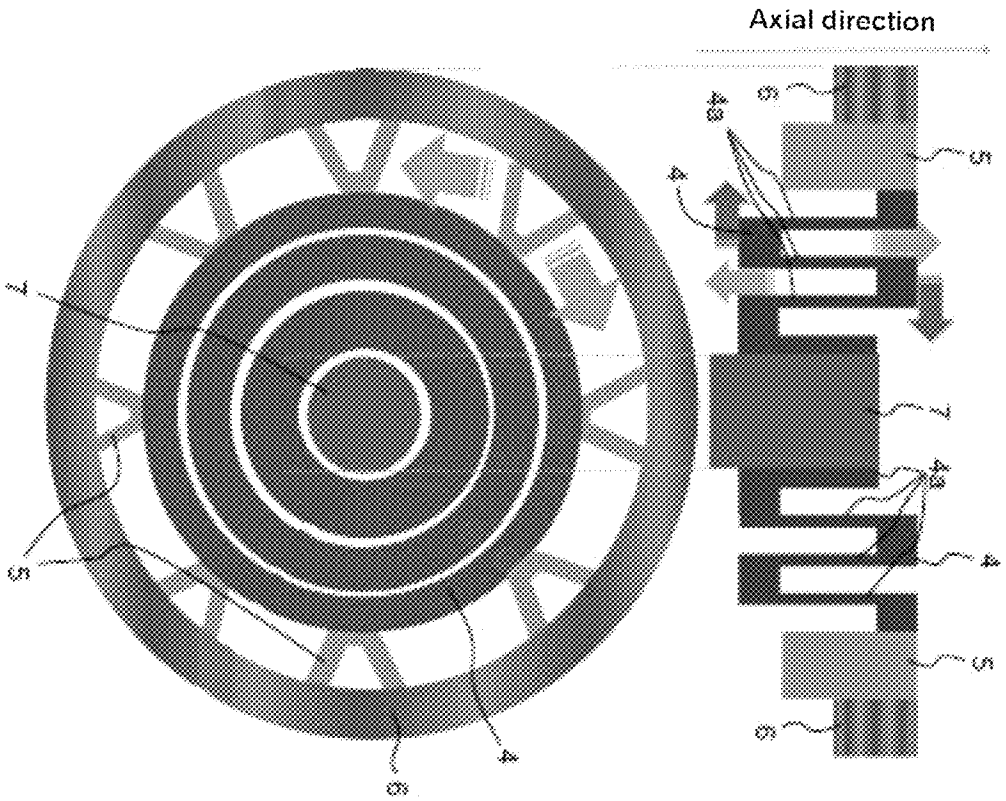
FIG. 2 schematically illustrates an annular cathode in cross-sectional view and plan view, according to one aspect of the invention.

The proposed invention, as represented in FIG. 2, is based on two coupled mechanical securing elements which act in synergy to maintain the concentricity and the alignment of all the components of the cathode when it is operating hot. The two securing elements are a folded skirt 4 and a plurality of lugs 5 disposed in series between a cylindrical central support 7 whose axis is that of the cathode and an outer peripheral electron emitter 6 with annular section whose axis is that of the cathode, extending over the outer perimeter of the cathode.

The folded skirt 4 makes it possible to compensate for the axial and radial deformations of the geometry of the cathode. The folded skirt 4 comprises sleeves or concentric tubular cylinders 4*a* which implement gauged flexible securing elements with opposing thermal expansion vectors to neutralize thermal expansion.

The plurality of lugs 5 makes it possible to neutralize orbital and radial deformations of the cathode. The lugs 5 are radial supports which link the outer peripheral electron emitter 6 to the folded skirt 4.

The axial neutralization can be obtained by adjusting the height (dimension in the axial direction) of the lugs. These lugs implement flexible securing elements which neutralize the radial expansion of the material by an isotropic counter-effect acting in the circumferential direction. The opposite expansion within a symmetrical deformation renders the electron emitter aligned in the desired condition, once the system has been dimensioned to exploit this condition.

These two securing elements 4, 5 are disposed in series. The folded skirt 4 is fixed to the cylindrical central support 7 of the annular cathode and to the lugs 5 which are fixed to the inner surface of the outer peripheral electron emitter 6.

The tubular cylinders 4*a* of the folded skirt 4 expand in opposing longitudinal and radial directions and, simultaneously, the lugs 5 expand in opposing orbital and radial directions. The presence of the tubular cylinders 4*a* renders the expansion of the electron emitter 6 balanced in the three axial, radial and orbital directions. The tubular cylinders 4*a* of the folded skirt 4 expand symmetrically in the axial direction of the annular cathode in both positive and negative directions, as a consequence of the symmetry of the expansion forces distributed over the sleeves themselves. The temperature discontinuities and the mechanical expansion differences along the tubular cylinders 4*a* of the folded skirt 4 are greatly limited.

There is a reduction of the heat flux from the electron emitter 6 to the support by virtue of the use of a plurality of securing elements 4*a*, which guarantees a long path in which the heat is radiated by the surfaces, which is reflected by an augmented thermal resistance (instead of the use of a single securing element, in which the heat would follow a path that is shorter and with fewer surfaces). During the heating of the structure, the mechanical deformations act in synergy with the lugs 5. The lugs 5 expand symmetrically in the orbital and radial directions in order to create an isotropic thermal deformation which maintains the concentricity between the outer peripheral electron emitter 6 and the rest of the cathode during the heating thereof. The result of symmetrical deformations in both directions on the three axes makes it possible to obtain perfect concentricity and alignment when the cathode is heated.

The limited thermal conduction between the outer peripheral electron emitter 6 and the securing elements 4, 5 is ensured by the star-configuration alternation of contact points of reduced size between the securing elements of the electron emitter and the sleeves. The securing elements are manufactured in appropriate materials (tungsten, molybdenum and moly-rhenium) and are designed by observing a constraint with respect to their form factor (reduced volume compared to surface area) in order to limit the thermal conduction. As a direct consequent, the thermal uniformity is ensured by the multiplicity of the contact points, which creates thermal discontinuities of low amplitude, each placed in a near space. The result is a negligible thermal non-uniformity of the electron emitter 6.

There is a partial break in the heat flux from the electron emitter 6 to the support 7, by virtue of the alternation of the contact points (instead of a single securing element, in which the heat is conducted directly from the emitter 6 to the support 7). There is, at each contact point between the securing element 5 and the electron emitter 6, a small temperature and expansion discontinuity by virtue of the plurality of the lugs 5 (instead of a great discontinuity, in the case of a smaller number of securing elements).

The structure of the securing elements 4, 5 can be inverted and the number of tubular cylinders 4*a* of the folded skirt 4 and/or the number of lugs 5 can be adapted for a better correlation of the sizes of the central support 7 and of the electron emitter 6, as a function of the size of the cathode.

The tubular cylinders 4*a* of the folded skirt 4 expand in opposing longitudinal and radial directions and, simultaneously, the star-configuration lugs 5 expand in opposing orbital and radial directions. The result of symmetrical deformations in both directions along the three axes causes the electron emitter 6 to be deformed thermally concentrically and aligned on the rest of the cathode structure. The limited thermal conduction between the electron emitter 6 and the securing elements 4, 5 is ensured by the alternation of contact points of reduced size between the electron emitter 6 and the lugs 5, with a thermal conduction given by the property of the material and the length ratio of the securing elements.

Figure 3:
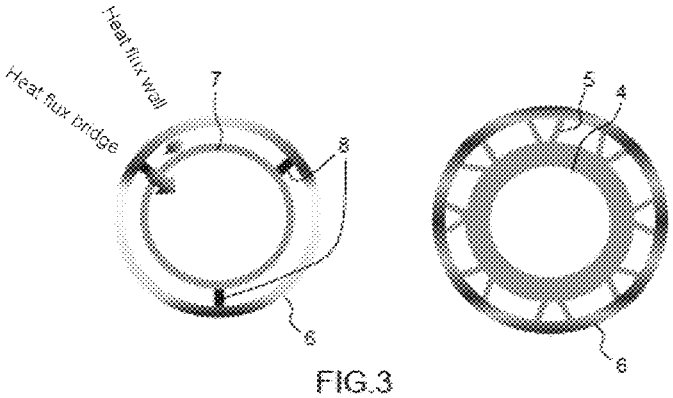
FIG. 3 schematically illustrates a comparison between an annular cathode of the state of the art and an annular cathode according to an aspect of the invention.

FIG. 3 schematically illustrates a comparison between an annular cathode of the state of the art and an annular cathode according to an aspect of the invention.

The known annular cathodes can expand with an anisotropic deformation when they heat up. The alignment and the concentricity of the electron emitter 6 relative to the other elements of the cathode can be compromised during the heating. Some existing solutions try to compensate for the longitudinal expansions of the electron emitter 6 in the axial direction. However, the radial and orbital expansions are not balanced and the result thereof is a non-uniformity of the thermal movement, as illustrated in the left hand part of FIG. 3. At the same time, the presence of discrete contact points between the electron emitter 6 and the traditional connections produces heat flux discontinuities and affects the thermal uniformity of the electron emitter 6. The thermal conduction of the support pads 8 (necessary for placing the electron emitter in the desired zone) produces a non-uniformity of the temperature of the support 7 and of the electron emitter 6 relative to the contribution added by the radiation effect.

The present invention, in addition to compensating for the thermal expansions, makes it possible to improve the thermal uniformity of the electron emitter 6. The reason lies in the geometry of the lugs 5: they are thin and flexible security elements. More securing elements gives a more uniform heat flux in more contact points, but the thinness of these securing elements guarantees an extremely low thermal conduction. In order to demonstrate how the proposed design makes it possible to resolve the real drawbacks, an example of known solution is compared to the proposed invention in FIG. 3.

Figure 4:
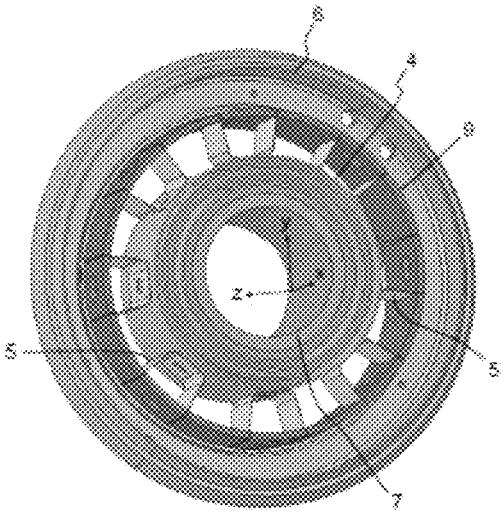
FIG. 4 schematically illustrates an annular cathode in plan view, according to an aspect of the invention.
Figure 5:
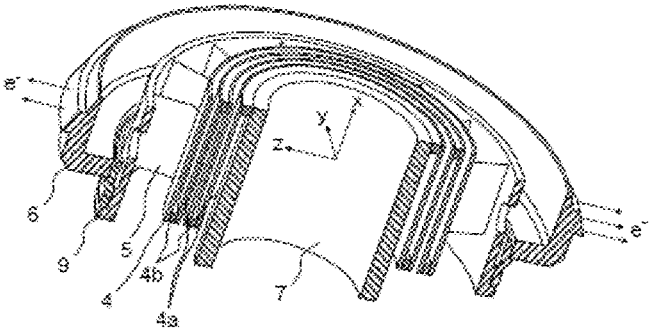
FIG. 5 schematically illustrates an annular cathode in cross-sectional view, according to an aspect of the invention.

FIGS. 4 and 5 schematically illustrate an annular cathode in plan view and cross-sectional view, according to an aspect of the invention.

This annular cathode for a vacuum tube comprises:

a tubular cylindrical central support 7 with circular section whose axis is that of the cathode;

an outer peripheral electron emitter 6 with annular section whose axis is that of the cathode, extending over the outer perimeter of the cathode; and a folded skirt 4, secured at its inner end to the central support, and secured, at its outer end, to a plurality of lugs 5;

each lug 5 being disposed in series with the folded skirt 4, and secured with the folded skirt 4 and with the inner surface of the electron emitter 6.

The folded skirt 4 comprises a plurality of concentric tubular cylinders 4*a* with circular sections, two consecutive cylinders 4*a* being linked alternately at one end and at the other of the tubular cylinders by a ring 4*b*.

The electron emitter 6 has an outer surface emitting electrons outwards.

The cylindrical central support 7 is tubular with circular section, and the lugs 5 are U-shaped.

A fixing support 9 for the lugs 5 is disposed between the electron emitter 6 and the lugs 5. The support 9 is provided with locations, such as slits, intended to slidingly receive the ends of the lugs 5, which can then simply be fixed by simple brazing. That simplifies the fixing of the lugs 5 to the electron emitter 6.

Figure 6:
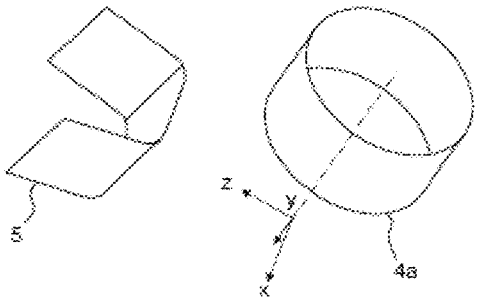
FIG. 6 schematically illustrates an example of a lug and of a folded skirt cylinder of an annular cathode according to an aspect of the invention.

FIG. 6 schematically illustrates an example of a lug and of a cylinder.

The volume-to-surface area ratio of a lug and/or of a cylinder of the folded skirt can be less than 0.06 mm.

For example, a lug 5 has a volume-to-surface area ratio of 0.05 mm, and a cylinder 4*a* of the folded skirt 4 has a volume-to-surface area ratio of 0.025 mm.

The invention claimed is:

1. An annular cathode for a vacuum tube, comprising:

a cylindrical central support whose axis is that of the cathode;

an outer peripheral electron emitter with annular section whose axis is that of the cathode, extending over the outer perimeter of the cathode; and a folded skirt, secured at an inner end to the central support, and secured, at its outer end, to a plurality of lugs;

each lug being disposed in series with the folded skirt, and secured with the folded skirt and with the inner surface of the electron emitter.

2. The annular cathode according to claim 1, wherein the folded skirt is of a single piece.

3. The annular cathode according to claim 1, wherein the folded skirt comprises a plurality of concentric tubular cylinders with circular sections, two consecutive cylinders being linked alternately at one end and at the other of the tubular cylinders by a ring.

4. The annular cathode according to claim 1, wherein the cylindrical central support is tubular with circular section.

5. The annular cathode according to claim 1, comprising a fixing support for the lugs disposed between the electron emitter and the lugs.

6. The annular cathode according to claim 1, wherein the lugs are U-shaped.

7. The annular cathode according to claim 1, wherein the lugs are angularly evenly distributed.

8. The annular cathode according to claim 1, wherein the volume-to-surface area ratio of a lug and/or of a cylinder of the folded skirt is less than 0.06 mm.

9. The annular cathode according to claim 7, wherein a lug has a volume-to-surface area ratio of 0.05 mm.

10. The annular cathode according to claim 7, wherein a cylinder of the folded skirt has a volume-to-surface area ratio of 0.025 mm.

* * * * *